US012760649B2

(12) United States Patent
Weaver et al.

(10) Patent No.: US 12,760,649 B2
(45) Date of Patent: Oct. 13, 2026

(54) ROCK BOLT INSTALLATION

(71) Applicant: SANDVIK MINING AND CONSTRUCTION AUSTRALIA (PRODUCTION/SUPPLY) PTY LTD, Queensland (AU)

(72) Inventors: Steven Weaver, New South Wales (AU); Mietek Rataj, New South Wales (AU); Jamie Wang, Queensland (AU)

(73) Assignee: SANDVIK MINING AND CONSTRUCTION AUSTRALIA (PRODUCTION/SUPPLY) PTY LTD, Milton (AU)

( * ) Notice: Subject to any disclaimer, the term of this patent is extended or adjusted under 35 U.S.C. 154(b) by 52 days.

(21) Appl. No.: 18/854,895

(22) PCT Filed: Mar. 30, 2023

(86) PCT No.: PCT/AU2023/050237
§ 371 (c)(1),
(2) Date: Oct. 7, 2024

(87) PCT Pub. No.: WO2023/193042
PCT Pub. Date: Oct. 12, 2023

(65) Prior Publication Data

US 2025/0305416 A1 Oct. 2, 2025

(30) Foreign Application Priority Data

Apr. 8, 2022 (EP) ..... 22167455

(51) Int. Cl.
*E21D 21/00* (2006.01)
*E21D 20/02* (2006.01)

(52) U.S. Cl.
CPC ..... *E21D 21/004* (2013.01); *E21D 21/006* (2016.01); *E21D 20/021* (2013.01); *E21D 20/025* (2013.01)

(58) Field of Classification Search
CPC . E21D 21/0026; E21D 21/004; E21D 21/006; E21D 21/0066
See application file for complete search history.

(56) References Cited

U.S. PATENT DOCUMENTS 4,861,197 A * 8/1989 Calandra, Jr. ..... E21D 21/008 D8/387
5,531,545 A 7/1996 Seegmiller et al.
(Continued)

FOREIGN PATENT DOCUMENTS

AU 2010223134 A1 9/2011
AU 2013203198 A1 1/2014
(Continued)

OTHER PUBLICATIONS https://www.dictionary.com/browse/about; 2026.*
IMEL Steel Catalogue and Mining Rock Files.

*Primary Examiner* — Sean D Andrish
(74) *Attorney, Agent, or Firm* — Corinne R. Gorski

(57) ABSTRACT

A rock bolt installation for a hole formed in a rock strata includes a cable bolt and a friction bolt disposed within the hole. The cable bolt can be embedded in grout, cement or resin. The cable bolt extends further into the hole than the friction bolt. The cable bolt and the friction bolt are disposed in an overlapping relationship within the hole and are connected structurally in the overlap to each other and to the internal wall of the hole.

13 Claims, 3 Drawing Sheets

(56) References Cited

U.S. PATENT DOCUMENTS

| | | | | |
|---|---|---|---|---|
| 6,270,290 | B1 | 8/2001 | Stankus et al. | |
| 6,527,482 | B1 * | 3/2003 | Stankus ..... | E21D 21/006 106/36 |
| 2002/0110426 | A1 | 8/2002 | Stankus et al. | |
| 2012/0034035 | A1 | 2/2012 | Sligar et al. | |

FOREIGN PATENT DOCUMENTS

| | | | |
|---|---|---|---|
| DE | 4432128 | * | 6/1996 |
| WO | 00/52304 | | 9/2000 |

* cited by examiner

ROCK BOLT INSTALLATION

RELATED APPLICATION DATA

This application is a $371 National Stage Application of PCT International Application No. PCT/AU2023/050237 filed Mar. 30, 2023, with priority to European patent application 22167455.9, filed on 8 Apr. 2022 the contents of which is to be considered to be incorporated into this specification by this reference.

TECHNICAL FIELD

The present invention relates to a reinforcement bolt for reinforcing rock strata, principally, but not exclusively for use in the underground mining industry.

BACKGROUND OF THE INVENTION

The discussion of the background to the invention that follows is intended to facilitate an understanding of the invention. However, it should be appreciated that the discussion is not an acknowledgement or admission that any aspect of the discussion was part of the common general knowledge as at the priority date of the application.

Elongate bolts are used for reinforcing rock strata by inserting the bolt within a hole drilled into the rock strata and fixing the bolt within the hole. Bolts can be fixed within a hole by frictional engagement with the wall of the hole or they can be embedded within the hole within grout or resin. The trailing end of a bolt can extend out the open end of the hole and a rock plate can be attached to the trailing end and can be tightened to press firmly against the rock face that surrounds the hole opening. The fixing of the bolt within the hole resists egress of the bolt from the hole and the bolt supports the rock surrounding hole against fracture. Likewise, the rock plate supports the rock face against fracture. Safety mesh can be installed broadly across the rock face by anchoring the mesh to multiple rock bolts. The rock bolts and the safety mesh thus combine to support the rock strata against fracture and collapse. The use of bolts and mesh is widespread in the underground mining industry to protect workers and equipment in underground mines and tunnels.

The bolts used to reinforce rock strata include rigid bolts, that have a solid bar or tube, and flexible cable bolts. In underground installations, the dimensions of the tunnel or chamber in which the bolt is to be installed limits the length of the rigid bolt that can be used and so where a greater length is required, a flexible cable bolt can be employed. The cable of a cable bolt can be unwound from a coil or reel and so effectively any length of cable can be deployed.

Rigid bolts have an advantage that they can be anchored by frictional engagement within a hole and thus those bolts can provide immediate reinforcement or ground support upon installation. In contrast, cable bolts are installed embedded in grout and full ground support is not effective until the grout has cured and the cable has been tensioned to support the rock face about the opening of the hole. Curing of the grout can take several days, resulting in delaying the access of mining personnel to the tunnel or chamber. In particular, only when the grout has cured can the end of the cable at the opening of the hole be anchored and tensioned to support the rock face by rock plate engagement. However, cable bolts have the advantage of being able to be inserted much further into a rock strata than rigid bolts.

It is an object of the present invention to provide a new form of rock bolt installation that provides improved operation compared to installations that are currently available, or that at least provides the consumer with an alternative.

SUMMARY OF THE INVENTION

According to the present invention there is provided a rock bolt installation, the installation comprising:

- a hole formed in a rock strata,
- a cable bolt and a friction bolt disposed within the hole, the cable bolt optionally being embedded in the grout, cement or resin,
- the cable bolt extending further into the hole than the friction bolt,
- characterised in that
- the cable bolt and the friction bolt are disposed in overlapping relationship within the hole and are connected structurally in the overlap to each other and to the internal wall of the hole.

If the rock bolt installation is to be used without grout, cement or resin, the rock bolt installation can comprise:

- a cable bolt and a friction bolt disposed in overlapping relationship within a hole, the cable bolt extending further into the hole than the rock bolt,
- characterised in that
- the friction bolt exerts clamping pressure against the cable bolt to clamp the cable bolt against an internal surface of the hole.

If the rock bolt installation is to be used without grout, cement or resin, the cable bolt can also be a friction bolt, for example as shown in Australian Patent 2013203198.

Further discussion will be made in relation to rock bolt installations used with grout, cement or resin, as this is expected to be the approach that is normally adopted. It is to be appreciated however that installations that do not use grout, cement or resin remain within the broadest scope of the invention.

The rock bolt installation according to the present invention advantageously employs overlapping bolting comprising a cable bolt and a friction bolt, in which the friction bolt can be either of a rigid bolt or a flexible cable bolt. The rigid bolt can have a rigid bar or rod, or it can have a rigid tube. The cable bolt provides greater penetration into the rock strata than the friction bolt to support the rock strata through the full length of the hole, but reinforcement or ground support by the cable bolt is delayed while the grout, cement or resin cures. In contrast, the friction bolt can provide reinforcement or ground support of the opening section of the hole closest to or in the region of the opening of the hole, immediately upon installation. The rock strata thus benefits from immediate ground support by the friction bolt, meaning that personnel can access the reinforced or supported tunnel or chamber immediately and safely to complete suitable activities while the grout, cement or resin is curing. Once the grout, cement or resin has cured or set, the cable bolt is fully operational and so full ground support is provided and all normal activities within the reinforced or supported area can be undertaken.

Moreover, once the grout, cement or resin has cured or set, the area of overlap between the cable bolt and the friction bolt is more fully stabilised than if only the cable bolt or the friction bolt were present in the opening section of the hole. This is highly advantageous as rock strata is likely to be less stable closer to the wall or face of an excavated area than deeper into the rock strata and so more significant reinforcement or support of that area of the rock strata is beneficial.

Still further, the installation of the cable bolt and the friction bolt with grout, cement or resin, can be completed in one step or one operation, without the need to wait for the grout, cement or resin to cure (which can take several days) before sending installation personnel back to tension the cable bolt in order to support the rock face of the excavation. This is because the friction bolt provides the face support that the cable bolt would otherwise provide once it was tensioned. Advantageously, that support by the friction bolt is immediate as discussed above.

The terms "grout", "cement" and "resin" are given as the options available for anchoring the cable bolt within the hole. Typically grout and cement are the same product and often the product will be referred to in the industry as "grout cement" or "cement grout". Resin is also available for use, but grout is by far the more widely used product in underground mining rock bolting and on that bass, the term "grout will be used hereinafter to cover all available forms of curable anchor suitable for anchoring the cable bolt within the hole.

The cable bolt and the friction bolt are connected structurally in the overlap within the hole. The friction bolt could alternatively be known or described as a "link" bolt by the manner in which the cable bolt and the friction bolt are connected or linked structurally. That is, the cable bolt and the friction bolt do not exist independently within the hole but rather, they interact with each other in a way that there is a structural connection or link between them. The structural connection or link is made within the hole and extends to the rock face of the excavation by the provision of a rock plate anchored to the end of the friction bolt that extends out of the hole and which bears against the rock face under pressure. The cable bolt is thus linked to the rock face by the friction bolt. Advantageously, this rock face or surface support is provided by the friction bolt without delay and is in contrast to the use of a cable bolt on its own, where tensioning of the bolt to provide the support cannot be undertaken until the grout has cured.

In some forms of the invention, the structural connection can be provided by the cured grout interposed between the cable bolt and the friction bolt and confined within the hole. In these forms of the invention, the grout fills the hole in the spaces other than that taken up by the cable bolt and the friction bolt and forms a structural connection between them, and between the respective bolts and the wall of the hole in which they are installed. The structural connection becomes a connection that facilitates load transfer between the respective bolts, in particular transferring load from the friction bolt to the cable bolt so that the loads are transferred deeper into the rock strata, advantageously where the rock strata is likely to be more stable. The structural connection is not made before the grout cures, but is made as curing progress and is complete once curing is finished. The cured grout structurally connects the overlapping portions of the cable bolt and the friction bolt together and to the wall of the hole, so that the cable bolt and the friction bolt act together in reinforcing the rock strata and providing ground support.

While the grout is curing, the friction bolt reinforces or supports the rock strata over the length of the friction bolt. This is the immediate reinforcement or ground support referred to above. Once the grout has cured, the cable bolt and the friction bolt operate together to reinforce or support the rock strata over the length of the friction bolt. The structural connection between the cable bolt and the friction bolt made by the cured grout causes the cable bolt and the friction bolt to work together in providing the reinforcement or ground support. Inboard of the friction bolt (where "inboard" means further into the hole in a direction away from the rock face from the friction bolt), the cable bolt provides reinforcement or ground support to the rock strata for the depth of the hole, or over the length of the cable within the hole if the cable does not extend to the inner end of the hole. As indicated above, the cable bolt can transfer load from the overlap deeper into the rock strata. The structural connection or link is made within the hole and to the rock face of the excavation by rock plate engagement with the rock face under pressure from the friction bolt. The cable bolt is thus linked to the rock face by the friction bolt.

It is to be noted that the cable bolt is not required to connect to the rock face of the excavation; the friction bolt does this. The cable bolt is not required to be tensioned. This allows the single step installation process by removing the need to wait for the grout to cure and to then tension the cable bolt against the face of the excavation.

Structural connection between the cable bolt and the friction bolt is thus critical to the operation of the rock bolt installation as the benefits of the invention are not realised if the cable bolt and the friction bolt operate independently from each other.

While the structural connection between the cable bolt and the friction bolt can be made through the cured grout interacting with the respective bolts and the wall of the hole and through the friction bolt connection to the face of the excavation, the structural connection can alternatively or additionally include the friction bolt clamping the cable of the cable bolt against the wall of the hole. Accordingly, in some forms of the invention, the structural connection between the cable bolt and the friction bolt will be provided by a combination of a grout connection and a clamping connection between the cable bolt and the friction bolt. In other forms of the invention, the structural connection between the cable bolt and the friction bolt will be provided by a clamping connection only between the cable bolt and the friction bolt, so that the cable bolt will not be grouted in the overlapping region with the friction bolt.

The friction bolt can be of any suitable kind. Suitable friction bolts can employ a rigid bar, a flexible cable or a tube, including a split tube (a "split set" for example), although care would need to be taken with a split tube to ensure sufficient clamping load with the wall of the hole as split tubes typically exert lower clamping load compared to friction bolts that that employ mechanical expanders. Friction bolts that are considered to be suitable are disclosed in Australian Patent Nos 2010223134 and 2013203198. Other friction bolts will also be suitable.

A friction bolt can clamp the cable bolt in a section of the friction bolt, or along the full length of the friction bolt, depending on the type of friction bolt selected for use. For example, where the friction bolt employs an expandible tube, such as a split set, or of the kind disclosed in Australian Patent No 2010223134, the tube of the friction bolt is intended to engage against the hole for substantially the full length of the tube. Accordingly, in the present invention, the tube can likewise clamp the cable bolt against the hole for substantially the full length of the tube. This will clamp the cable bolt from adjacent the opening of the hole to the trailing end of the friction bolt. In contrast, the friction bolt disclosed in Australian Patent No 2013203198 employs a cable and an expander mechanism at the leading end of the cable and only the expander mechanism frictionally engages the hole. Accordingly, the friction bolt disclosed in Australian Patent No 2013203198 will clamp the cable of the cable bolt by the expander mechanism clamping against a section of the friction bolt at the leading end of the friction bolt.

Installation of the cable and friction bolts into the hole will ordinarily take place after the grout has been injected into the hole. So the typical installation sequence is to 1) drill a hole into the rock strata, 2) fill the hole with grout, 3) insert the cable bolt and then the friction bolt into the hole, pushing through the grout (and displacing it), 4) attaching a rock plate to the end of the friction bolt, and 5) tightening an anchor (usually a nut threaded onto the end of the friction bolt) to press the rock plate into firm engagement with the rock face about the opening of the hole. So when the cable and friction bolts are inserted, the hole will be full of grout, and some grout may be displaced out the open end of the hole but the majority of the grout will remain within the hole after bolt insertion. The aim is to fill the hole as close to complete as possible.

The friction bolt can employ an expandible tube, but there are difficulties in combining an expandible tube with a cable bolt in overlapping relationship. For example, it is not expected to be realistic for a split tube to push into a hole with the cable of a cable bolt interposed between the wall of the hole and the outside surface of the tube, because the cable would cause considerable resistance to insertion of the tube. The cable could cause the tube to buckle and prevent proper insertion of the tube into the hole, or the cable could buckle which would reduce the length of the engagement with the tube once the tube has been installed. The applicant has therefore developed arrangements in which the cable of the cable bolt is accommodated within the inside or interior of the expandible tube for the overlapping region of the rock bolt installation.

For the above arrangements, the tube can be pushed into the hole after the grout has been injected into the hole and after the cable of the cable bolt has been pushed into the hole through the grout. The tube is formed with an opening at the leading end of a width to facilitate entry of grout and the cable of the cable bolt into the interior of the tube as the tube is pushed into the hole so that the grout will fill or substantially fill the tube about the cable of the cable bolt. The grout can be left to cure and then to form a structural connection between the cable bolt and the friction bolt internally of the friction bolt, while the tube structurally connects to the wall of the hole bv frictional engagement with the wall. Longitudinally beyond the opening at the leading end of the tube the grout can form a structural connection between the cable bolt and with the facing wall of the hole.

To enhance the structural connection between the cable bolt and the friction bolt via the grout within the friction bolt, the wall of the tube of the friction bolt can include one or more internal deformations or grip features for keying with the grout so that the connection between the grout and the internal wall of the tube is improved. The internal deformations can comprise one, or two or more longitudinally spaced circumferential indents or grooves, or the deformations can be groove sections or nodules or other forms of inwardly extending or radial projections, such as by crimping for example.

The grout will cure about the internal deformations and this locks the grout into place within the tube. The grout is thus keyed to the internal deformations within the tube and this locks the grout from shifting in the tube by strata loading. The grout also connects with the cable bolt in the normal manner within the tube and beyond the leading end of the tube where it connects with the cable bolt and with the wall of the hole. By this arrangement, the tube of the friction bolt can be structurally connected with the cable bolt within the tube (which is the overlap between them) and the tube can structurally connect with the wall of the hole by frictional engagement with the wall.

Moreover, once the grout sets within the tube it becomes a very stiff element reinforcing the tube from the inside against radial contraction. This is expected to increase the both the strength of the tube and its connection with the wall of the hole. This is because when a split tube is at rest before installation in a hole, it has a greater diameter than the hole it is to be inserted into. The tube must therefore radially contract to enter the hole and the radial contraction creates the engagement load between the tube and the wall of the hole. For an installed tube to slide back out of the hole, there also needs to be a at least a slight radial contraction of the tube. Without cured grout within the tube, the resistance to radial contraction comes solely from the strength of the tube, but once the grout has cured, the grout provides additional resistance to contracting from the inside the tube.

In contrast, where the friction bolt employs an expander mechanism at the leading end of a bar, rod or cable of the friction bolt, the friction bolt can push into the grout so that the grout is present about the expander mechanism and in the spaces between the hole and the bar, rod or cable of the friction bolt and in the spaces between the friction bolt and the cable of the cable bolt. Grout can thus be present for substantially the full length of the hole from the opening of the hole at the rock face to the inner end of the hole. The grout can be present close to the rock plate of the friction bolt, or to the collar of the friction bolt that bears against the rock plate. In fact, as much grout as possible will be pumped into the hole and if the grout fills the hole a small amount of it will come out of the hole at the opening or entry at the rock face as the cable bolt and the friction bolt are pushed into the hole through the grout (because there is no other exit for the grout). So there is usually plenty of grout at the opening or entry of the hole at the rock face, although whether or not the grout comes into contact with the rock plate is not important for the present invention as the structural connection is the connection made within the hole. The structural connection between the cable bolt and the friction bolt will thus be a combination of the grout connection between the cable bolt and the friction bolt and any clamping connection between the two bolts and the grout connection and clamping connection with the wall of the hole. In this arrangement, the grout will make a greater contribution to the structural connection between the cable bolt and the friction bolt and to the internal wall of the hole.

As explained above, a connection or link between the cable bolt and the friction bolt is important to give the structural connection between the respective bolts and without that connection or link, the increased or improved reinforcement or ground support that is realised by the combination of the cable bolt and the friction bolts working together, is not provided. It follows, that the rock bolt installation according to the present invention is not simply a pair of rock bolts (the cable bolt and the friction bolt) that each perform individually as expected. Rather, the inclusion of the pair of rock bolts that have a structural connection between them provides increased reinforcement or ground support at the opening section of the hole, compared to installations that include only one of the pair of rock bolts, while advantageously, reinforcement or ground support of the rock strata at the opening section of the hole is immediate upon installation and importantly, while the grout is still curing. Once cured, the respective bolts work together to distribute loads upwardly or along or away from the friction bolt to the cable bolt deeper within the rock strata. Without the structural connection between the respective bolts, that redistribution would not happen and the friction bolt would be required to withstand all of the load applied to it.

In typical cable bolt installations, the cable of the cable bolt would extend generally along the axis of the hole, although it might approach and engage the hole at points along its length. Precise axial alignment of the cable within the hole is not necessary. Also, the cable can include widened sections to improve the purchase of the cable within the hole once the grout has cured, such as by expanding the strands of the cable to form a bulb section, or other arrangements can be applied to the cable for gripping within the cured grout to resist being pulled out of the hole under loading by the rock strata. With this in mind, in a rock bolt installation according to some forms of the present invention, the cable of the cable bolt can be spaced from the friction bolt in the overlapping section of the cable and friction bolts so that the connection between the respective bolts is by the grout between them, but otherwise the respective bolts are not connected to each other. The cable of the cable bolt can extend in close proximity to the wall of the hole in the region of the overlap, or in close proximity to the friction bolt, but without contact with the friction bolt. The cable of the cable bolt can be in contact with the wall of the hole in the overlapping region or in sections of that region. Alternatively, the cable of the cable bolt can be engaged by the friction bolt, either passively, without clamping the cable against the wall of the hole, or in a clamping arrangement in which the cable of the cable bolt is clamped against the wall of the hole. The clamping can be in a section of the length of the friction bolt or along the full length of the friction bolt, depending on the type of friction bolt employed. The cable of the cable bolt can assume its normal position within the grout beyond the leading end of the friction bolt.

In a specific form of the invention, the elongate cable bolt will have leading and trailing ends with the leading end being disposed in the region of an inner end of the hole, which is the innermost part of the hole spaced or remote from the entry or opening of the hole at the rock face of the excavation (a 10 m hole for example) and the trailing end being disposed within the hole in the region of the entry or opening of the hole. The rock bolt will also have leading and trailing ends with the leading end being disposed within the hole and the trailing end being disposed at the entry or open end of the hole. The friction bolt will extend into the hole for a much shorter distance compared to the cable bolt (2 m for example). The friction bolt will include a rock plate at the trailing end in bearing engagement with rock face about the hole, and the rock bolt will extend into the hole in overlapping relationship with the cable bolt for a portion of the length of the cable bolt. The rock bolt will exert clamping pressure against the cable bolt to clamp the cable bolt against an internal surface of the wall of the hole and the cable bolt and the friction bolt will be embedded in grout from the entry or open end of the hole to the inner end of the hole.

If the friction bolt includes an expander mechanism that clamps against the hole, the clamping parts or expander leaves or elements of the expander mechanism can be shaped to accommodate the cable of the cable bolt so that the cable can extend past or through the expander mechanism in either axial direction within the hole. By this accommodation, there is no structural connection between the friction bolt and the cable of the cable bolt and so the structural connection between them will be provided by the cured grout.

Alternatively, the expander elements of the expander mechanism can engage the cable of the cable bolt to clamp the cable to the hole and in some forms of the invention, the expander elements of the expander mechanism can be shaped for clamping engagement with the cable of the cable bolt. The expander mechanism can include a wedge and the clamping part of the expander mechanism can be a clamping leaf or element which can be shifted radially by axial movement relative to the wedge to engage the hole. The wedge can be a central wedge and two, three or four clamping leaves or elements can be spaced about the wedge for shifting movement into clamping engagement with the hole by the central wedge being shifted axially relative to the elements. In existing forms of expander mechanisms, the wall engaging surfaces of the elements are generally flat although they can be slightly curved to more closely mate with the curved hole. In some forms of the present invention however, the wall engaging surfaces of one or more of the elements is shaped to have a mating surface that accepts or nests with a portion of the cable. The mating surface can be curved to form a groove, slot or scallop for example, so that a concave curve or profile is formed. The groove, slot or scallop can be of approximately equal or similar radius to the radius of the cable of the cable bolt. The profile could alternatively be V-shaped for example.

The mating surface of the expander mechanism element can interact with the cable of the cable bolt to clamp the cable to the hole, or the mating surface can be arranged to accept or accommodate the cable but without clamping the cable to the hole. Accordingly, a groove, slot or scallop could be formed in the mating surface that has a depth that is less than the diameter of the cable so that the cable is pressed against the hole when the expander mechanism is expanded. Alternatively, a groove, slot or scallop could be formed in the mating surface that has a depth that is greater than the diameter of the cable so that the cable can enter the scallop fully when the expander mechanism is expanded and without being clamped against the hole. The cable would be loose within the groove, slot or scallop. If the cable is loose within the scallop, then there is no structural connection between the cable bolt and the friction bolt at the expander mechanism and the structural connection is made by the cured grout. However, if the cable is clamped by the mating surface against the hole, then the structural connection is provided either by that clamping effect alone if there is no grout connecting the cable bolt and the friction bolt, or it is made by the clamping effect in combination with the cured grout if there is grout connecting the cable bolt and the friction bolt.

The mating surface can be a serrated surface or include a serrated section for engaging the wall of the hole. If the mating surface is curved to form a groove, slot or scallop for example, peaks will be formed on either side of the groove, slot or scallop or between the groove, slot or scallop and those peaks can be serrated. The serrations, such as the serrated peaks will improve the grip with which the elements engage the wall of the hole.

Where the structural connection between the cable bolt and the friction bolt is made by the cured grout, the overlap between the cable bolt and the friction bolt should be at least as long as the critical embedment length of the cable. The critical embedment length is described in the industry text "Cablebolting in Underground Mines" by D. Jean Hutchinson & Mark S. Diederichs, as an expression to describe the active length of grouted cable under unidirectional slip and the minimum embedment length at which cable rupture occurs during pullout. The critical embedment length will depend on many factors that will be familiar to a person skilled in the art. The structural connection can of course be longer than the dimension of the critical embedment length, but should not be less.

The structural connection between the cable bolt and the friction bolt made by the cured grout facilitates transfer of load in the lower rock strata in the region of the friction bolt upwards and into higher strata above the friction bolt via the cable bolt. At the same time the lower rock strata is secured against rock fall by the friction bolt, even before the grout has cured. The friction bolt can support the lower rock strata particularly with the use of a rock plate that bears against the face of the rock strata and by securing safety mesh broadly across the rock face.

The rock bolt installation is intended to be employed with the cable bolt having a significant length and the friction bolt being installed at the open end of the hole and extending for a much shorter distance into the hole. For example, the ratio of the extension of the friction bolt into the hole compared to the cable bolt, including the overlapping region between the respective bolts could be between 1/20 to 1/3 of the total length of the hole or cable (depending on whether the cable extends the full length of the hole). The cable of the cable bolt may have a length of about 6 m to 20, although the cable could be as short as about 4 m. The friction bolt can have a length of 1 m to 4 m.

The extent of desirable overlap between the friction bolt and the cable bolt can be calculated on the overlap length or dimension that is required to ensure effective coupling of the cable and friction bolts (which will be dependent on such factors as the critical embedment length as described above, the length of the grout section between the cable bolt and the wall of the hole which can be made to have greater strength than the cable itself, so that if the cable is sufficiently tensioned, the cable it will break or fail rather than slip), and this has been calculated to be about 1 m for some suitable cable bolts.

The length of the friction bolt is dependent on establishing a minimum overlap length with the cable bolt and on extending far enough into the rock mass for a sufficient frictional connection to the rock to be achieved to generate a suitable connection with the wall of the hole. This will vary but typically in normal height mining (i.e. not low seam) 1.8 to 3 m is required.

Based on the ratios given above, some suitable combinations include 1.8 m friction bolt combined with 6 m cable bolt (1:3.33), 2.4 m friction bolt to 10 m cable bolt (1:4.166) and 3 m friction bolt to 20 m cable bolt (1:6.66). Other ratios are possible and for example, there is an expectation that a 2.4 m friction bolt would be suitable to combine with a 20 m cable bolt (1:8.33).

BRIEF DESCRIPTION OF THE DRAWINGS

In order that the invention may be more fully understood, some embodiments will now be described with reference to the figures in which.

DETAILED DESCRIPTION

Figure 1:
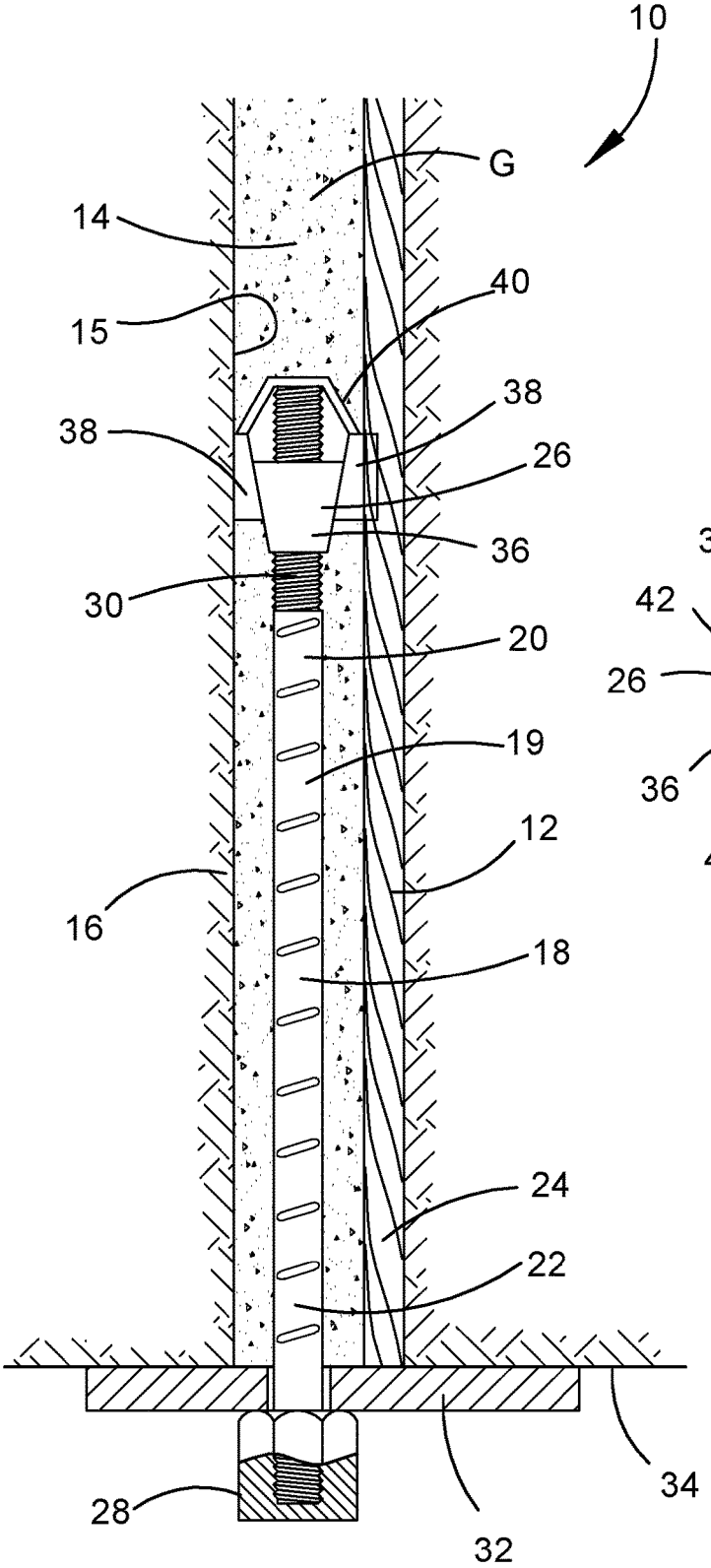
FIG. 1 is a cross-sectional view of a rock bolt installation according to one embodiment of the invention.

FIG. 1 is a cross-sectional view of a rock bolt installation 10 according to one embodiment of the invention. The installation 10 includes an elongate cable bolt 12 which is shown as a multi strand, single cable in FIG. 1. The cable bolt 12 can have any number of strands, or alternatively, it could be a single strand cable.

The cable bolt 12 is installed within a hole 14 that has been drilled into a rock body or rock strata 16 to a predetermined depth or length, for example to a depth of about 10 m. FIG. 1 illustrates only a short portion of the total length of the hole 14 along with only a short portion of the cable bolt 12. In practice, the cable bolt 12 would extend for substantially the full length of the hole 14.

The cable bolt 12 is anchored within the hole 14 by grout G. This will be described in more detail hereinafter, but the cable bolt 12 is formed as a single cable with no fittings at either end of the cable or along the length of the cable. Suitable fittings could be applied, such as will facilitate better anchoring or purchase of the cable bolt 12 within the grout G, while the cable of the cable bolt 12 could be formed with widened or expanded sections known as "bulbs" to likewise improve the anchor or purchase of the cable within the grout G within the hole 14. Suitable fittings are known in the art.

The installation 10 further includes a friction bolt 18 that extends adjacent to or in overlapping relationship with the cable bolt 12 and which has a shank 19 and leading and trailing ends 20 and 22. The trailing end 22 of the friction bolt 18 is adjacent the trailing end 24 of the cable bolt 12. The leading end of the cable bolt 12 is not visible in FIG. 1. The friction bolt 18 can be alternatively called a "link bolt" as it links to the cable bolt 12 via a structural connection as described below.

The friction bolt 18 has an expander mechanism 26 at the leading end 20, which is threadably connected to the threaded end 30 of the shank 19. The friction bolt 18 has a nut 28 at the trailing end 22. The nut 28 is a blind nut that is threaded onto the trailing end 22. In other embodiments, the nut 28 can be formed integrally with the end of the shank 19. The nut 28 is threaded onto the threaded end of the shank 19 until the end of the shank 19 engages the inner end of the opening in the nut 28, so that further rotation of the nut 28 rotates the shank 19. Rotation of the shank 19 will activate the expander mechanism 26.

A rock plate 32 is interposed between the nut 28 and the face 34 of the rock strata 16 into which the hole 14 is drilled. The rock plate 32 supports the rock strata 16 about the opening of the hole 14 and applies pressure against the face of the rock strata 16 as the nut 28 is rotated and the expander mechanism 26 is activated. As will be explained, load applied to the rock plate 32 will be transferred upwards via the friction bolt 18 and into higher strata above the friction bolt via the cable bolt 12. This transfer relies on the structural connection between the cable bolt 12 and the friction bolt 18, and the wall 15. While not illustrated, safety mesh can be secured broadly across the rock face by clamping the mesh between the nut 28 and the rock plate 32 of multiple friction bolts 18.

Figure 2:
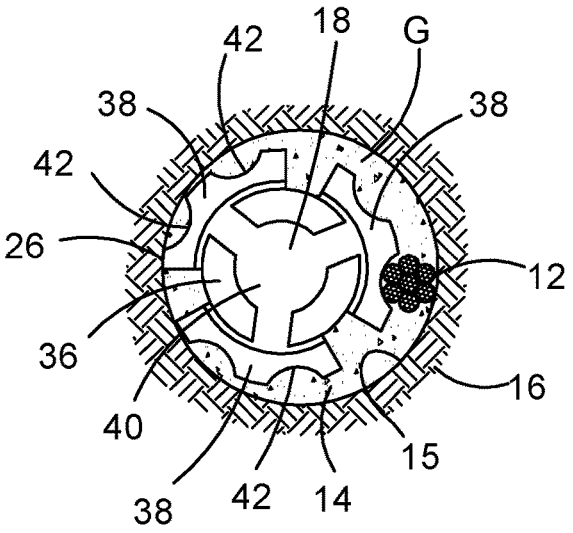
FIG. 2 is a cross-sectional view through taken through the expander mechanism of the rock bolt installation of FIG. 1.

The expander mechanism 26 comprises a central wedge 36 and three leaves or elements 38. The expander mechanism is illustrated in FIG. 2 in end view and shows the three elements 38 spaced equidistantly about the central wedge 36. FIG. 2 also shows the "bail" 40 (which is also shown in FIG. 1) which overlies the top end of the threaded end 30 of the shank 19 and which has three arms that connect to the upper edges of the elements 38. The bail 40 is not connected to the central wedge 36. The bail 40 secures the elements 38 against movement along the longitudinal axis of the shank 19 and so the elements 38 are secured within the hole 14 at a generally constant axial position. The central wedge 36 is threadably connected to the threaded end 30 of the shank 19. The central wedge 36 can be restrained against rotation with the shank 19 simply by frictional engagement with the elements 38, or the central wedge 36 can be made non-circular with the elements 38 having complementary mating surfaces, including mating keyways. By rotating the nut 28 in the same direction that it threads onto the shank 19, the central wedge 36 can be shifted axially or longitudinally downwardly on the threaded end 30 relative to the elements 38 and by that movement, the elements can be forced radially into firm engagement with the wall 15 and with the cable bolt 12 as shown in FIG. 1.

It can be seen from FIGS. 1 and 2, that the cable bolt 12 and the friction bolt 18 are disposed within the hole 14 in adjacent, side-by-side or overlapping relationship. Also apparent from FIGS. 1 and 2, is that the hole 14 is filled with grout G which is shown by the random dotted pattern which is applied to the spaces or voids within the hole 14 that are otherwise not filled by the cable bolt 12 or the friction bolt 18.

The installation method is to first drill the hole 14 into the rock strata 16 and following that to pump the grout G into the hole. The grout G can be delivered by a grout hose that is fed to the back or inner end of the hole 14 and which is retracted as the grout G is progressively pumped into the full length of the hole 14. Following this, the cable bolt 12 can be fed into the hole 14. The cable bolt 12 would normally be fed from a storage reel which is attached to installation machinery. Once the cable bolt 12 has been installed within the hole 14, the friction bolt 18 can be installed. Installation machinery can be used to push the friction bolt 18 into the hole 14 and through the grout G to the point at which the friction bolt 18 is almost fully inserted into the hole 14. The installation of the friction bolt 18 can include percussion driving, to ensure grout flow fully about the bolt 18 and to the trailing end 22 of the bolt 18.

The nut 28 is then tightened, expanding the expander mechanism 26 and pushing the rock plate 32 firmly against the face 34 of the rock strata 16. At this stage, the friction bolt 18 is fully installed and operational and is providing reinforcement or ground support for the length of the friction bolt 18 between the expander mechanism 26 and the rock plate 32. That reinforcement or support is immediate and facilitates access to the tunnel or chamber in which the rock bolt installation 10 is made, by personnel and equipment. The cable bolt 12 is also fully installed, but is not operational until the grout G cures, which can be several days. Once the grout G has fully cured, the full length of the hole 14 is reinforced or supported.

In the rock bolt installation 10, the cable bolt 12 and the friction bolt 18 are connected structurally and in the embodiment illustrated, that structural connection is a combination of 1) the cured grout G that is interposed between the cable bolt 12 and the friction bolt 18, and the wall 15 of the hole 14 and 2) a clamping load applied by the elements 38 of the expander mechanism 26 against the wall 15, and by the element 381 (see FIG. 2) against the cable bolt 12 to clamp the cable bolt 12 against the wall 15 of the hole 14. However, it will be appreciated from the discussion earlier herein, that the structural connection could be facilitated through the grout G alone, or by the clamping load of the expander mechanism 26 of the friction bolt 18 alone.

The structural connection provided by the grout G is provided once the grout G has cured. Once the grout G has cured, it is a rigid and hard body within which the cable bolt 12 and the friction bolt 18 are embedded. By the rigid connection, load experienced by the friction bolt 18 can be transferred through the grout G to the cable bolt 12, so that reinforcement or ground support is extended upwardly from the friction bolt 18 to the cable bolt 12 and into what will likely be more stable rock strata. Accordingly, the grout G does not simply fill the spaces or voids within the hole 14 that are otherwise not filled by the cable bolt 12 or the friction bolt 18, but rather, the grout G structurally connects the hole 14 and the cable bolt 12 and the friction bolt 18 together.

The structural connection provided by the expander mechanism 26 acts in fundamentally the same way as the grout G, except that the structural connection is confined to the location of the expander mechanism 26 rather than extending the full length of the friction bolt 18. The expander mechanism 26 thus clamps against the cable bolt 12 and against the wall 15 of the hole 14. This is shown clearly in FIG. 2.

Figure 3:
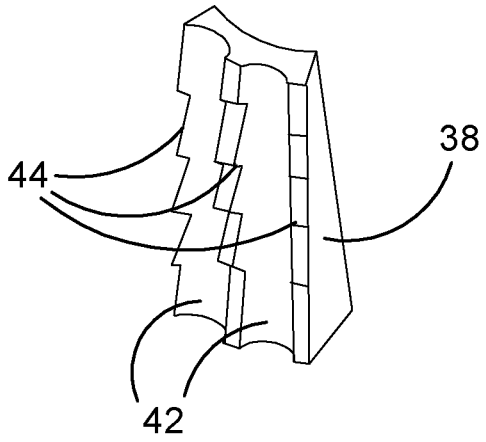
FIG. 3 is an end view of an expander element of the expander mechanism of the rock bolt installation of FIG. 1.

FIGS. 2 and 3 show the outer surfaces of the elements 38 as formed with concave recesses or scallops, so that the cable bolt 12 can be securely captured or accommodated for clamping against the wall 15. Each of the elements 38 includes a pair of recesses 42 so that the expander mechanism 26 does not need to be inserted into the hole 14 in a particular orientation for one of the recesses 42 to align with the cable of the cable bolt 12. Thus, as the expander mechanism 26 is expanded, the likelihood is high that the cable bolt will be received in one of the recesses 42. The use of the concave recesses 42 also tends to support the cable of the cable bolt 12 against distortion by the clamping load against the wall 15.

The concave recesses or scallops 42 can be of other shape or form and can be of greater radial depth in order to accept a greater amount of the cable bolt 12. The recesses 42 can also have a radial depth that is greater than the diameter of the cable bolt 12 so that the cable bolt 12 is received within a recess 42 but is not pressed or clamped against the wall 15. In that arrangement, the cable bolt 12 can be a close but lose fit within the recess 42.

One of the elements 38 is shown in isolation in FIG. 3 and this figure shows that the peaks 44 of the elements 38 on either side of the recesses 42 are serrated. These serrated peaks are provided to improve the grip with which the elements 38 engage the inside walls 15 and 64 of the holes 14 and 52 of FIGS. 1 and 4. The serrated peaks would replace the flat surfaces normally provided in expandible elements and the serrations will allow the peaks to dig into the wall of the holes in which the expander mechanism is inserted.

While the installation 10 is shown including a friction bolt 18 that includes a rigid shank 19 (formed as a bar or rod) the invention is also applicable to friction bolts employ cables rather than rigid bars or rods.

Figure 4:
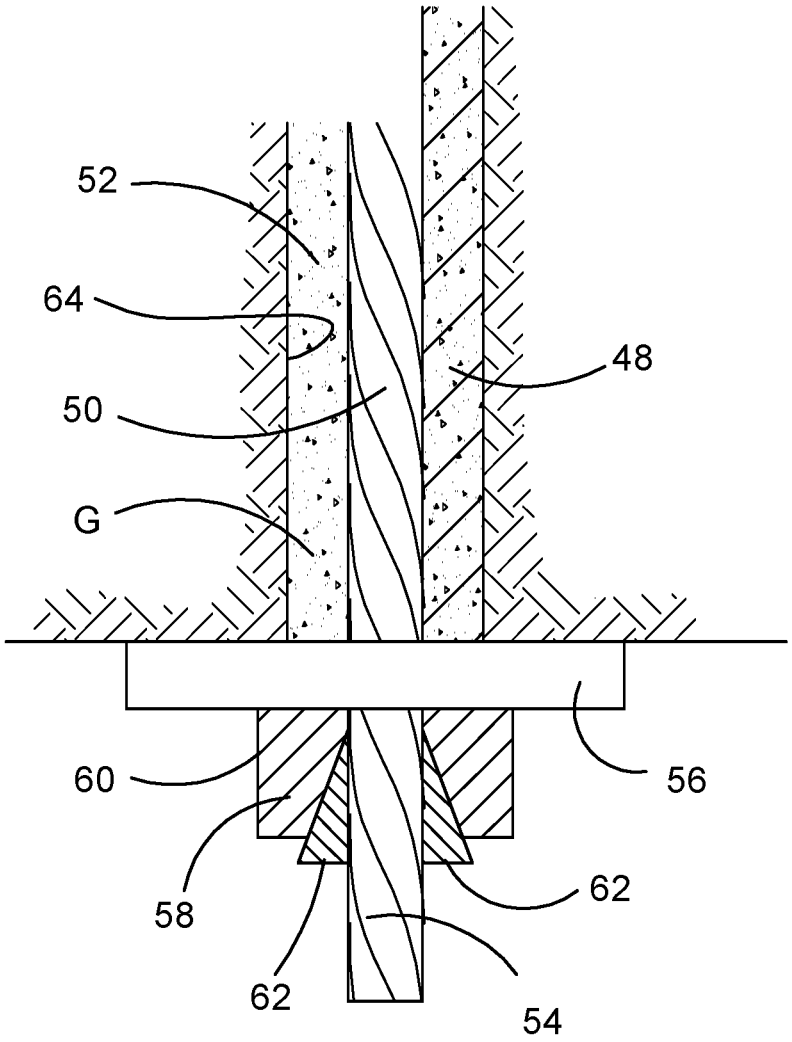
FIG. 4 is a cross-sectional view of a section of a rock bolt installation according to another embodiment of the invention.

FIG. 4 shows an arrangement in which the friction bolt has a cable 50 instead of the rigid shank 19 of the friction bolt 18 of FIG. 1. In FIG. 4, the rock bolt installation includes a cable bolt 48 that is equivalent to the cable bolt 12 of FIG. 1, and so the cable bolt 48 comprises a cable that is embedded in grout with no fittings at either end of the cable or along the length of the cable. The cable bolt 50 is installed in overlapping or side-by-side relationship with the cable bolt 48, but the cable bolt 50 is formed as a friction bolt so that it has an expander mechanism at the leading end thereof (not shown in FIG. 4) that engages and clamps frictionally against the inside wall 64 of the hole 64 in the same manner as the expander mechanism 26 of the friction bolt 18, although the form of the expander mechanism employed with the cable bolt 50 will be different to the expander mechanism 26, as the cable bolt 50 does not have a threaded end on which the expander mechanism can be fixed. Persons skilled in the art will have knowledge of the type of expander mechanism that can be attached to the leading end of the cable bolt 50.

The respective bolts 48 and 50 are installed within the hole 52 and the trailing end 54 of the cable bolt 50 is secured against a rock plate 56 by an anchor 58 of an existing form, that comprises an outer barrel 60 and a pair of, or more likely three, inner wedges 62. Persons skilled in the art will understand that the trailing end 54 can be tensioned by pulling through the anchor 58, with the wedges 62 gripping the outside surface of the trailing end 54 to prevent return movement of the trailing end 54 in the reverse or opposite direction through the anchor 58.

In FIG. 4, the structural connection between the respective cable bolts 48 and 50 is by the cured grout G while there can be an additional structural connection if the expander mechanism of the cable bolt 50 clamps the cable bolt 48 against the wall 64 of the hole 52. The structural connections in the rock bolt installation of FIG. 4 are the same as the structural connections in the rock bolt installation 10 of FIGS. 1 and 2, despite the different use of a rigid bar friction bolt 18 in FIG. 1 as compared to a flexible cable friction bolt 50 of FIG. 4.

Figure 5:
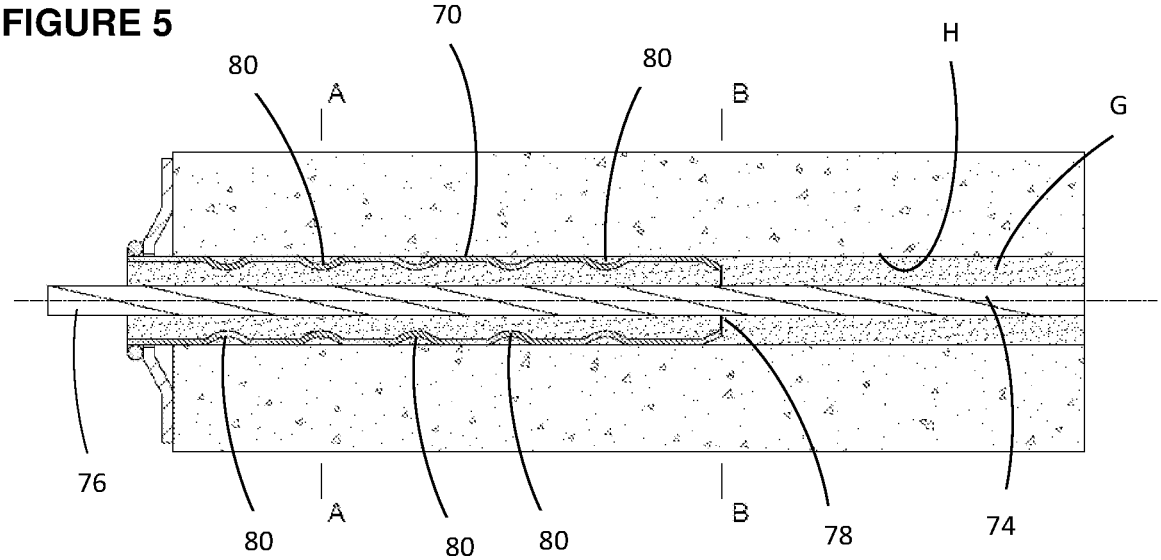
FIG. 5 is a cross-sectional view of a rock bolt installation according to a second embodiment of the invention.
Figure 6:
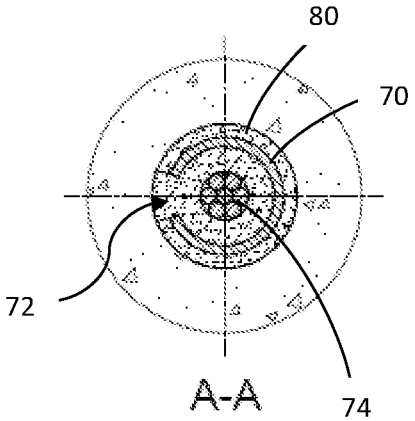
FIGS. 6 and 7 are cross-sectional views respectively through A-A and B-B of FIG. 5.
Figure 7:
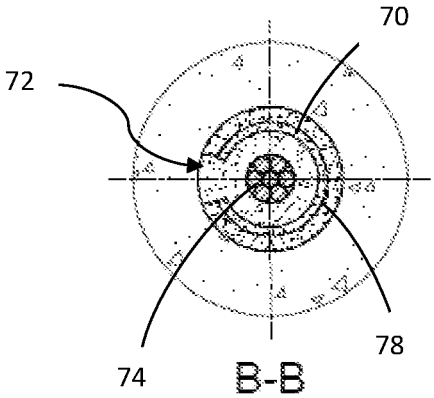

FIGS. 5 to 7 show an arrangement that employs a friction bolt that is a split tube 70. These types of friction bolt are relatively cheap and easy to install and so are preferred where the rock strata is appropriate for their use.

Before describing the FIGS. 5 to 7 arrangement, it is important to understand that a typical split tube has an outer diameter that is greater than the inner diameter of a hole that the tube is to be installed into and so the tube is forced to collapse radially on forced insertion into the hole. This means that the tube firmly engages the wall of the hole frictionally and forms a very tight connection with the hole wall for substantially the full length of the tube. The manner in which the tube engages the wall of the hole is different to friction bolt 18 of FIG. 1, which has the expander mechanism 26 at the leading end of the bolt 18 and so which only engages to hole wall at one relatively small region but under very high load.

Use of a split tube in the present invention poses difficulties. As previously explained, it is not realistic for a split tube to push into a hole with the cable of a cable bolt interposed between the wall of the hole and the outside surface of the tube, because 1) the cable would resist insertion of the tube 70, 2) the cable could cause the tube to buckle and prevent insertion in the hole, or 3) the cable could buckle and reduce the length of the engagement with the tube.

The present invention thus proposes that the cable be accommodated within the interior of the tube of the friction bolt. A problem to be overcome is to ensure that as the tube is pushed into the hole, it feeds about the cable bolt and that grout substantially fills the tube about the cable bolt to ensure that a suitable structural connection will be made by the grout between the cable bolt and the tube.

In FIG. 5, the friction bolt is a split tube 70 which is shown in longitudinal cross-section, having been pushed into the hole H through the grout G and about the cable 74 of the cable bolt 76. The tube 70 would be pushed into the hole H after the grout G has been injected into the hole H and after the cable 74 of the cable bolt 76 has been pushed into the hole H through the grout G.

The tube 70 engages a substantial portion of the circumference of the wall of the hole H over the major length of the tube 70. The tube 70 has a longitudinal split or gap 72 as shown in FIGS. 6 and 7. The gap 72 interrupts only a relatively small section of the circumference of the tube 70.

FIGS. 5 to 7 show that the tube 70 is filled with grout G. While the figures cannot represent actual field outcomes so that complete filing of the entire tube 70 cannot be guaranteed, the opening 78 of the tube 70 is of a width to facilitate entry of the cable 74 and the grout G into the interior of the tube 70, while the wall of the tube 70 includes internal deformations for keying to the grout G so that the grout G can connect more firmly to and grip the tube 70. In FIG. 5, the internal deformations comprise a plurality of longitudinally spaced circumferential indents or grooves 80 which form key or grip features for the grout G to key to or grip when the grout G has cured. The grooves 80 can be circumferential grooves that extend completely about the tube 70, or the grip features can alternatively be groove sections or nodules or other forms of inwardly extending or radial projections.

The grout G thus cures between the grooves 80 and the grout G is locked into place between the grooves 80, because the wider sections of grout G between the grooves 80 cannot be pulled past the inwardly extending grooves 80. The grout G connects with the cable 74 of the cable bolt 76 in the usual manner and with the inside of the tube 70 by keying with the grooves 80, while longitudinally beyond the opening 78 of the tube 70, the grout G connects with the cable 74 and with the facing wall of the hole H in the usual manner. By the provision of the internal deformations in the form of the grooves 80 and by ensuring the opening 78 of the tube 70 is sufficiently open, the tube 70 can be structurally connected with the cable 74 in the overlap between them and the tube 70 can be structurally connected to the wall of the hole H bv frictional engagement with the wall.

FIGS. 6 and 7 show cross-sectional views of the FIG. 5 arrangement and FIG. 6 shows that the grout G can flow into the spaces formed between the tube 70 and the wall of the hole H at the grooves 80. The grout G can thus enhance the connection between the tube 70 and the wall of the hole H. FIG. 7 shows that the opening 78 of the tube 70 has approximately the same inner diameter as that of the grooves 80 and that the leading end of the tube 70 is not completely folded in. This construction is intended to make the opening 78 large enough to minimise or at least reduce the difficulty with insertion of the tube 70 into the grout G and about the cable 74. Narrower openings would increase that difficulty.

The end of the tube 70 that protrudes from the hole H has a collar 82 fixed to the outside of the tube and in bearing engagement with a rock plate 84 that bears against the facing surface of the rock strata about the opening of the hole H. Persons skilled in the art will understand the operation of the collar 82 and the rock plate 84.

Those skilled in the art will appreciate that the invention described herein is susceptible to variations and modifications other than those specifically described. It is understood that the invention includes all such variations and modifications which fall within the spirit and scope of the present invention.

The invention claimed is:

1. A rock bolt installation comprising:

a cable bolt and a friction bolt, the cable bolt and the friction bolt being arranged to be disposed within a hole formed in a rock strata, the cable bolt extending further into the hole than the friction bolt, wherein the cable bolt and the friction bolt are disposed in an overlapping relationship within the hole and are connected structurally in an overlap to each other and to an internal wall of the hole, wherein the friction bolt includes an expander mechanism arranged to clamp against the internal wall of the hole, and wherein expander elements of the expander mechanism are shaped to accommodate a cable of the cable bolt so that the cable can extend past or through the expander mechanism in either axial direction within the hole, and wherein the expander elements of the expander mechanism engage the cable of the cable bolt to clamp the cable to the internal wall of the hole.

2. The rock bolt installation according to claim 1, wherein the cable bolt is embedded in grout, cement or resin.

3. The rock bolt installation according to claim 2, wherein a structural connection is provided by the grout interposed between the cable bolt and the friction bolt and the internal wall of the hole, or by the friction bolt clamping a cable of the cable bolt against the internal wall of the hole, or by a combination of the grout interposed between the cable bolt and the friction bolt and the internal wall of the hole and the friction bolt clamping the cable of the cable bolt against the internal wall of the hole.

4. The rock bolt installation according to claim 3, wherein the friction bolt clamps the cable of the cable bolt in a section of the overlap between the cable and friction bolts at a leading end of the friction bolt.

5. The rock bolt installation according to claim 4, wherein the friction bolt includes an expander mechanism at a leading end of a bar, rod or cable of the friction bolt, and wherein the grout disposed about the expander mechanism and in spaces between the hole and the bar, rod or cable of the friction bolt and in spaces between the friction bolt and the cable of the cable bolt.

6. The rock bolt installation according to claim 1, wherein the friction bolt is a rigid bolt or a flexible cable bolt.

7. The rock bolt installation according to claim 1, wherein a ratio of an extension of the friction bolt into the hole compared to an extension of the cable bolt into the hole, including the overlap between respective bolts being between 1/20 to 1/3 of a total length of the hole or cable.

8. The rock bolt installation according to claim 7, wherein a cable of the cable bolt has a length of 4 m to 20 m, and wherein the friction bolt has a length of 1 m to 4 m.

9. The rock bolt installation according to claim 1, wherein the overlap between the friction bolt and the cable bolt is at least equal to or greater than a critical embedment length.

10. The rock bolt installation according to claim 1, wherein the expander elements of the expander mechanism are arranged to accept or accommodate the cable of the cable bolt, the expander elements including a groove, slot or scallop for the cable to enter.

11. The rock bolt installation according to claim 1, wherein the friction bolt includes an expander mechanism arranged to clamp against the internal wall of the hole, the expander elements of the expander mechanism including a serrated surface for engaging the internal wall of the hole.

12. The rock bolt installation according to claim 1, wherein the friction bolt is a rigid tube, and wherein the cable bolt extends through the tube, the tube being substantially filled with grout around the cable bolt, a wall of the tube including one or more internal deformations arranged for keying with the grout.

13. A rock bolt comprising:

a tendon having a leading end and a trailing end;

an expander mechanism disposed at the leading end; and an anchor mechanism disposed at the trailing end, the expander mechanism including expander elements that are expandible into engagement with an internal wall of a hole, the expander elements being arranged to accept or accommodate a cable of a cable bolt, wherein the expander elements include a groove, slot or scallop for the cable to enter, wherein the expander mechanism is arranged to clamp against the internal wall of the hole, and wherein expander elements of the expander mechanism are shaped to accommodate the cable so that the cable can extend past or through the expander mechanism in either axial direction within the hole, and wherein the expander elements of the expander mechanism engage the cable of the cable bolt to clamp the cable to the internal wall of the hole.

* * * * *